US008827102B2

(12) United States Patent
Zack et al.

(10) Patent No.: US 8,827,102 B2
(45) **Date of Patent: *Sep. 9, 2014**

(54) DEVICE FOR HOLDING BATH TOYS

(71) Applicant: Skip Hop, Inc, New York, NY (US)

(72) Inventors: Elizabeth Zack, Brooklyn, NY (US); Rany Joo, Hawthorne, NY (US); Janet Villano, Brooklyn, NY (US); Ellen Diamant, New York, NY (US)

(73) Assignee: Skip Hop, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/782,560

(22) Filed: Mar. 1, 2013

(65) Prior Publication Data

US 2013/0193014 A1 Aug. 1, 2013

Related U.S. Application Data

(63) Continuation of application No. 12/578,205, filed on Oct. 13, 2009, now Pat. No. 8,387,783.

(51) Int. Cl.
*A47K 5/08* (2006.01)
*A47K 3/00* (2006.01)

(52) U.S. Cl.
CPC ..... *A47K 3/001* (2013.01); *Y10S 206/829* (2013.01)
USPC ..... 220/483; 206/829; 248/206.3

(58) Field of Classification Search
USPC ..... 206/77.1, 829; 220/495.1, 483, 480; 383/13, 22, 27, 26, 106, 117; 248/13, 248/22, 26, 27, 106, 117, 213.2, 206.4; 224/563, 482, 559
See application file for complete search history.

(56) References Cited

U.S. PATENT DOCUMENTS

| | | | | | |
|---|---|---|---|---|---|
| 1,714,263 | A | * | 5/1929 | Garvin | 224/568 |
| D147,587 | S | * | 9/1947 | Kaplan | D6/564 |
| 2,553,739 | A | * | 5/1951 | Ashdowne | 224/441 |
| 2,619,705 | A | * | 12/1952 | Foster | 428/219 |
| 2,698,155 | A | * | 12/1954 | Bowman | 248/311.2 |
| 2,739,755 | A | * | 3/1956 | Ottinger | 383/30 |
| 3,085,027 | A | * | 4/1963 | Porteous | 442/67 |
| 3,338,293 | A | * | 8/1967 | Hohmann | 160/370.21 |
| 3,342,343 | A | * | 9/1967 | Youlden | 211/88.01 |
| 3,417,875 | A | * | 12/1968 | Barker | 211/86.01 |
| 3,869,183 | A | * | 3/1975 | Frank, Jr. | 312/248 |
| 4,101,104 | A | * | 7/1978 | Minard | 248/95 |
| D265,152 | S | * | 6/1982 | Bruno et al. | D6/525 |
| 4,936,480 | A | * | 6/1990 | Apostolo | 220/485 |
| 4,979,833 | A | * | 12/1990 | Cook | 383/12 |
| D316,646 | S | * | 5/1991 | Cunningham | D6/525 |
| 5,104,077 | A | * | 4/1992 | Liu | 248/205.8 |

(Continued)

*Primary Examiner* — David Fidei

(74) *Attorney, Agent, or Firm* — Stephen J. Weyer, Esq.; Terry L. Wright, Esq.; Stites & Harbison PLLC

(57) ABSTRACT

A device for holding bath toys is provided that includes a flexible receptacle having a back panel and a front panel adjoined by opposing sides and a bottom of the receptacle. At least a portion of the bottom of the receptacle is formed of a mesh material. The top portion of the back panel and an upper edge of the front panel define an open end of the receptacle. The device can be attached to a bathroom wall, for example by using at least two posts which extend through a respective opening in the receptacle and at least two caps, each cap defining a bore for receiving the post and for secure attachment to the post.

22 Claims, 5 Drawing Sheets

(56) References Cited

U.S. PATENT DOCUMENTS

| | | | | | |
|---|---|---|---|---|---|
| 5,118,201 | A * | 6/1992 | Cook | 383/12 |
| 5,253,775 | A * | 10/1993 | Gould | 220/23.83 |
| 5,350,058 | A * | 9/1994 | Keough | 220/505 |
| D359,409 | S * | 6/1995 | Dean, II | D6/567 |
| D383,348 | S * | 9/1997 | Frankel | D6/563 |
| 5,702,003 | A * | 12/1997 | Springer | 206/457 |
| 5,765,604 | A * | 6/1998 | Garvey, III | 141/86 |
| 5,772,490 | A * | 6/1998 | Leach | 446/71 |
| 5,823,366 | A * | 10/1998 | Bellamy | 211/119.011 |
| 5,971,192 | A * | 10/1999 | Immerman et al. | 220/483 |
| 6,089,395 | A * | 7/2000 | Karttunen et al. | 220/23.87 |
| 6,092,772 | A * | 7/2000 | Garcia et al. | 248/205.5 |
| 6,170,593 | B1 * | 1/2001 | Hatanaka | 180/219 |
| 6,241,388 | B1 * | 6/2001 | Terramani | 383/22 |
| 6,301,724 | B1 * | 10/2001 | Wright | 4/559 |
| 6,318,922 | B1 * | 11/2001 | Briggs | 401/201 |
| 6,325,344 | B1 * | 12/2001 | Gary et al. | 248/206.3 |
| 6,431,386 | B1 * | 8/2002 | Hofman et al. | 220/481 |
| D471,391 | S * | 3/2003 | Murphy | D6/524 |
| 6,546,572 | B2 * | 4/2003 | Demonet | 4/559 |
| 6,663,458 | B1 * | 12/2003 | Jauregui | 446/73 |
| 6,820,782 | B1 * | 11/2004 | Monson | 224/413 |
| 6,931,821 | B2 * | 8/2005 | Wong | 53/420 |
| 7,014,363 | B2 * | 3/2006 | Hanson | 383/120 |
| 7,021,825 | B1 * | 4/2006 | Schultz | 383/76 |
| 7,080,756 | B2 * | 7/2006 | Cunningham | 221/26 |
| 7,302,715 | B1 * | 12/2007 | Finell | 4/559 |
| 8,387,783 | B2 * | 3/2013 | Zack et al. | 206/77.1 |
| 2001/0020621 | A1 * | 9/2001 | Immerman et al. | 220/483 |
| 2001/0045440 | A1 * | 11/2001 | Nelson | 224/563 |
| 2002/0012480 | A1 * | 1/2002 | Konno | 383/111 |
| 2002/0043535 | A1 * | 4/2002 | Immerman | 220/483 |
| 2002/0181806 | A1 * | 12/2002 | Godshaw et al. | 383/6 |
| 2005/0023238 | A1 * | 2/2005 | Wong | 215/252 |
| 2006/0049674 | A1 * | 3/2006 | Fair | 297/188.2 |
| 2006/0168720 | A1 * | 8/2006 | Dellarocca | 4/559 |
| 2007/0039986 | A1 * | 2/2007 | Tomasi | 224/401 |
| 2007/0071366 | A1 * | 3/2007 | Kao | 383/38 |
| 2007/0175787 | A1 * | 8/2007 | Lown et al. | 206/427 |
| 2008/0023512 | A1 * | 1/2008 | Merzon | 224/625 |
| 2008/0197135 | A1 * | 8/2008 | Berman | 220/375 |
| 2008/0217493 | A1 * | 9/2008 | Bevirt | 248/163.1 |
| 2009/0145903 | A1 * | 6/2009 | Soltis et al. | 220/288 |
| 2009/0268990 | A1 * | 10/2009 | Wilson et al. | 383/13 |

* cited by examiner

DEVICE FOR HOLDING BATH TOYS

CROSS REFERENCE TO RELATED APPLICATION

This is a Continuation application to U.S. patent application Ser. No.: 12/578,205 filed on Oct. 13, 2009, which issued as U.S. Pat. No.: 8,387,783 on Mar. 5, 2013, herein incorporated by reference.

TECHNICAL FIELD

The presently-disclosed subject matter relates to devices for holding bath toys. In particular, the presently-disclosed subject matter relates to devices for holding bath toys that include a receptacle attached to a mounting plate through the use of posts and caps.

BACKGROUND

In most households, bathtubs are small, confined spaces that play host to a variety of personal items including shampoos, soaps, and the like. As such, there is generally a limited amount of storage space available for additional items, such as bath toys for children. Many parents frequently provide their children with toys to play with during bath time and to make bath time an enjoyable occasion for the children. However, many problems frequently arise from providing children with bath toys during bath time because these toys are often left lying on the bottom of the bathtub after they are used.

Leaving toys on surface of bathtub not only creates a cluttered and disorganized space that must be cleaned up before a subsequent individual takes a bath or a shower, it also increases the risk for mold and mildew formation on the bathtub and on the bath toys themselves. Indeed, the moist surfaces that remain on the bottom of a bathtub after taking a bath provide a damp environment for mold and mildew to form and proliferate. This formation of mold and mildew poses a significant health risk for individuals, especially young children. To that end, numerous devices have been designed and manufactured for storing and draining wet bath toys, which allow parents to avoid the inconvenient task of rinsing, drying, and storing the toys after every bath.

However, currently-available bath toy storage devices are less than sufficient. Many of the bath toy storage devices that are currently available are comprised of plastic structures that only contain a few holes in select portions of the devices for draining water from the bath toys. As such, a requisite amount of air can not flow through the bath toy storage devices and some bath water inevitably remains on the toys and within the bath toy storage devices, thus encouraging mold and mildew formation. Furthermore, many of the current designs for bath toy storage devices are large and cumbersome, or cannot be easily removed from the bathtub itself or from the walls of a bath room, thus making it difficult to remove and clean the devices. In any event, known devices for holding bath toys fail to adequately address the problem of mold and mildew formation, or sufficiently provide a means to easily remove and clean the device, which is also of great importance.

SUMMARY

The presently-disclosed subject matter includes devices for holding bath toys.

In one exemplary embodiment, a device for holding bath toys is provided that comprises a flexible receptacle having a back panel and a front panel adjoined by opposing sides and a bottom of the receptacle, a portion of which is formed of a mesh material. At least two posts are provided for attachment to a wall. In one advantageous form, the post can be inserted through respective holes or openings in the receptacle. At least two caps, each defining a bore for receiving the post, can then be inserted onto the posts to secure the receptacle to the post. In some embodiments, the back surface of each cap is wider in diameter then the openings in the top portion of the back panel such that the receptacle can not be easily pulled over the caps and removed from the post. In some embodiments, the at least two posts are associated with a respective number of suction cups for attachment to the respective post. Accordingly, the post can be attached to a cap on one end and suction cup on the other.

In some exemplary embodiments of the presently-disclosed devices for holding bath toys, the caps are selectively removable from the posts. In some embodiments, the posts are threaded such that they can be received by corresponding threads in the bore of each cap. Further, in some embodiments, a means for interlocking each cap to each threaded post is provided such that the cap can be secured to the threaded post after it is twisted on. In some embodiments, the means for interlocking each cap to each threaded post comprises at least one threaded segment on a post that extends in a direction parallel to the longitudinal axis of the post and further comprises at least one groove in the threaded bore of the cap that receives the threaded segment of the post.

In some embodiments, the caps of the presently-disclosed devices for holding bath toys further include a hooked portion that extends from a bottom portion of the cap and can be used for hanging a bathtub accessory. In such embodiments, the bottom portion of each cap further comprises an aperture from draining liquid from a concave portion of the cap such that bath water or other liquids do not collect in the concave portion of the cap.

To attach an exemplary device for holding bath toys to a wall or other surfaces such as a bath tub door, or the like, various means can be included on a mounting plate. In some (e.g., back) embodiments, a plurality of suction cups, such as four suction cups, are attached to a second side of the mounting plate and are used to attach the mounting plate to an appropriate surface. In some embodiments, at least two holes are defined by the mounting plate and are spaced at predetermined intervals along the length of the mounting plate such that screws or the like can be inserted into the holes and used to attach the mounting plate to a wall.

In some exemplary embodiments of the presently-disclosed device for holding bath toys, the receptacles are comprised of various materials to facilitate the use of an exemplary device for holding bath toys. In some embodiments, the back panel and the front panel can be comprised of neoprene material. In some embodiments, various portions of the receptacle, such as the bottom, sides, or a portion of the back panel, are comprised of mesh such that water can easily drain off of bath toys located within the receptacle. Further, in some embodiments, a mesh window is included in the front panel of the receptacle to allow users to view one or more toys located within the receptacle.

The presently-disclosed devices for holding bath toys allow a receptacle to be easily attached and secured to a variety of different walls or surfaces, but yet still allow for the receptacles to be easily removed and cleaned. Further, the presently-disclosed devices for holding bath toys can comprise a variety of mesh portions that allow the toys placed within the receptacle to dry, thus preventing mold and mildew formation.

Advantageously, in various alternative embodiments, the presently-disclosed devices are made of a material which dries quickly, e.g., neoprene, and the material is machine washable. Further, in various forms, the device is composed of a material which is stretchable, so as to expand to fit bath toys. In addition, in various embodiments, advantageously, the device has a wide opening at the top to allow one to easily place and remove bath toys from the device's receptacle.

DESCRIPTION OF EXEMPLARY EMBODIMENTS

The presently-disclosed subject matter includes devices for holding bath toys. In particular, the presently-disclosed subject matter includes devices for holding bath toys that include a receptacle attached to a bathroom wall using posts and caps.

Figure 1:
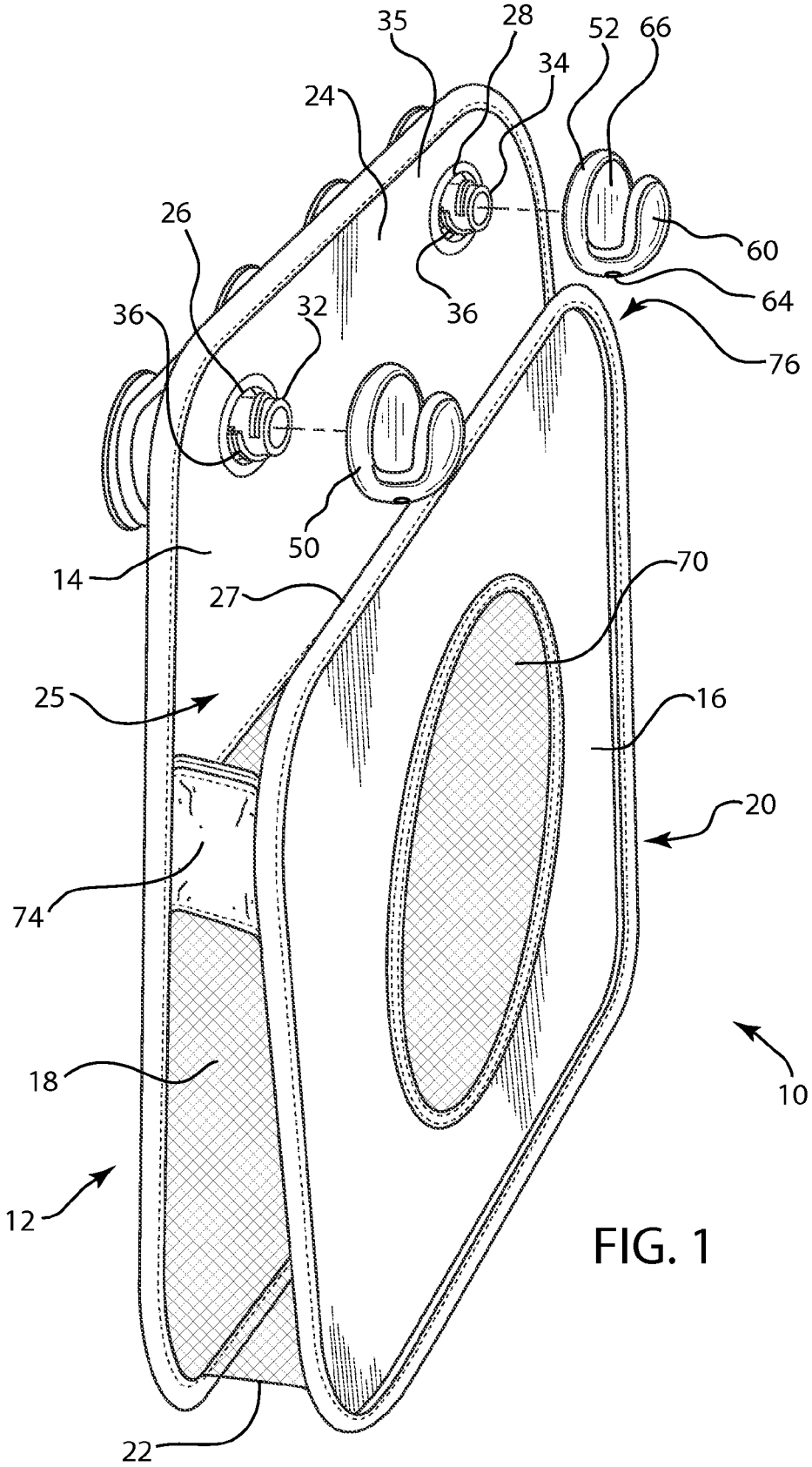
FIG. 1 is a perspective, partially exploded view of an exemplary device for holding bath toys made in accordance with the presently-disclosed subject matter, and showing each cap detached from the posts.

FIG. 1 includes a perspective view of an exemplary device for holding bath toys in accordance with the presently-disclosed subject matter. In this exemplary embodiment, a device for holding bath toys 10 is provided that comprises: a flexible receptacle 12 having a back panel 14 and a front panel 16 adjoined by opposing sides 18,20 and a bottom 22 of the receptacle 12, where a portion of the bottom 22 of the receptacle 12 is formed of a mesh material, a top portion 24 of the back panel 14 defines at least two openings 26,28, and the top portion 24 of the back panel 14 and an upper edge 27 of the front panel 16 define an open end 25 of the receptacle 12. The device 10 may include a mounting plate 30 having at least two posts 32,34 on a first side 35 of the mounting plate 30 and a means for attaching the mounting plate 30 to a wall or other suitable surface; and at least two caps 50,52 that each define a bore 54 for receiving and for securely attaching the caps to the posts 32,34. In some exemplary embodiments, such as the one illustrated in FIG. 1, an exemplary device 10 for holding bath toys can be provided that is about twelve inches wide, about fifteen inches long, and has a depth of about four inches in order to provide a device 10 for holding bath toys that can be easily installed in a small bathtub area and then used to hold a variety of bath toys.

Figure 3:
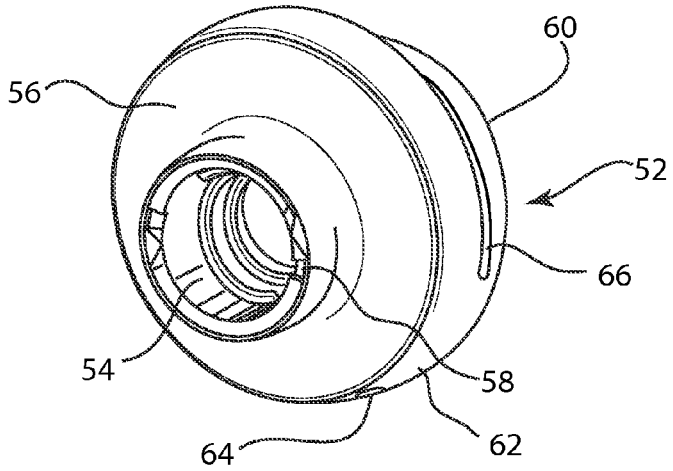
FIG. 3 is a back perspective view of the cap of the exemplary device for holding bath toys illustrated in FIG. 1.
Figure 4:
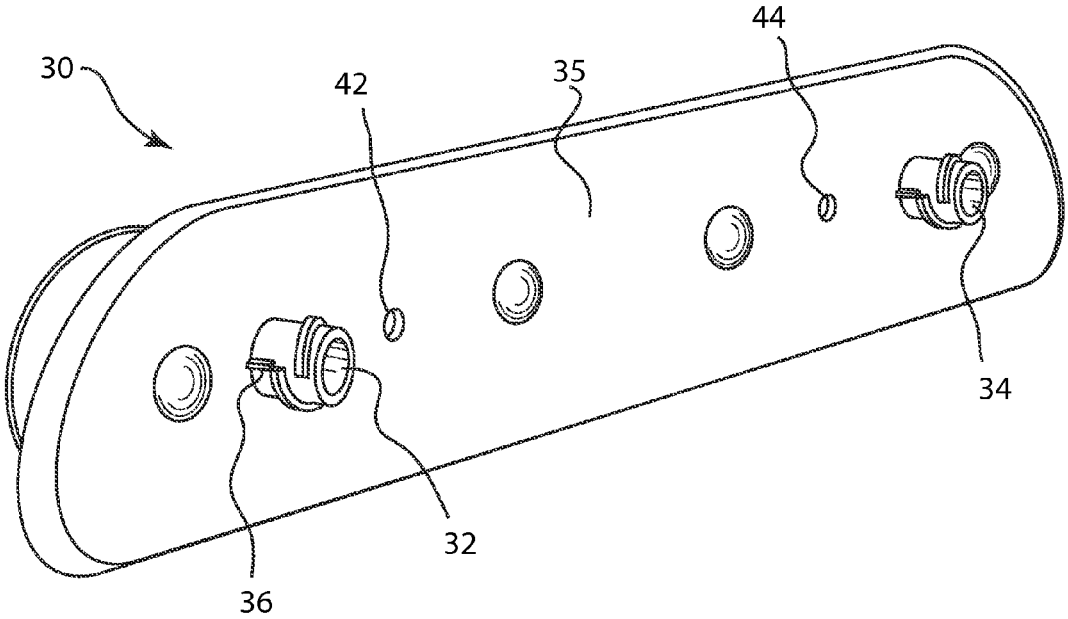
FIG. 4 is a front perspective view of a mounting plate of the exemplary device for holding bath toys illustrated in FIG. 1.

Referring now to FIGS. 3 and 4, an exemplary cap 52 of the presently-disclosed devices for holding bath toys is typically selectively removable from the posts 32,34 on the first side 35 of the mounting plate such that the caps 50,52 can be used to secure the receptacle 12 to the mounting plate 30, but can also be easily removed to allow the receptacle 12 to be cleaned. Of course, various means can be used to provide caps that are selectively removable from posts including, but not limited to, snapping fasteners, hooks, threaded sections, and the like. In one exemplary embodiment, as shown in FIGS. 3 and 4, the posts 32,34 and the bore 54 in each cap 50,52 are threaded such that, once the openings 26,28 in the top portion 24 of the back panel 14 of the receptacle 12 are hung on the posts 32,34, each cap 50,52 can be secured to the posts 32,34 by screwing the caps 50,52 onto the posts 32,34.

In some embodiments, to further secure the posts 32,34 to each cap 50,52 a means for interlocking each cap 50,52 to each threaded post 32,34 is provided. Still referring to FIGS. 3 and 4, in some embodiments, the means for interlocking each cap 50,52 to each threaded post 32,34 comprises at least one threaded segment 36 on each post 32,34 that extends in a direction that is parallel to the longitudinal axis of each post 32,34, and at least one groove 58 defined in the threaded bore 54 of each cap. In such embodiments, when the caps 50,52 are screwed on to each threaded post 32,34, the groove 58 in each cap 50,52 receives and engages the threaded segment 36 on each post 32,34 to thereby interlock each cap 50,52 to each threaded post 32,34 such that the caps 50,52 can not readily be unscrewed from each of the posts 32,34 without applying additional force.

In some exemplary embodiments of the presently-disclosed devices for holding bath toys, the caps 50,52 can further comprises additional features to facilitate the use of an exemplary device 10 in a bathtub setting. For example, as illustrated in FIG. 3, in some embodiments, a back surface 56 of a cap 52 is provided that is wider in diameter than the openings 26,28 in the top portion 24 of the back panel 14 of the receptacle 12. By providing a back surface 56 of the cap that is wider in diameter than the openings 26,28, the receptacle 12 is not only further secured to the mounting plate 30, but the openings 26,28 in the back panel 14 of the receptacle can not be simply pulled over the caps, such as may otherwise occur when a child is pulling on the receptacle to retrieve his or her toys from within the receptacle. As another example of additional features that can be incorporated into the caps 50,52, in some embodiments and as also illustrated in FIG. 3, each cap 50,52 can further include a hooked portion 60 that extends from a bottom portion 62 of the caps 50,52 for hanging a bathtub accessory, such as a washcloth, loofah, or the like. In such embodiments, the bottom portion 62 of an exemplary cap 52 further defines an aperture 64 for draining liquids from a concave portion 66 of the cap 52 such that, after a washcloth is hung on the hooked portion 60 to dry, water or other bath liquids do not remain in the concave portion 66 of the cap 52, which may encourage mold and mildew formation.

Figure 2:
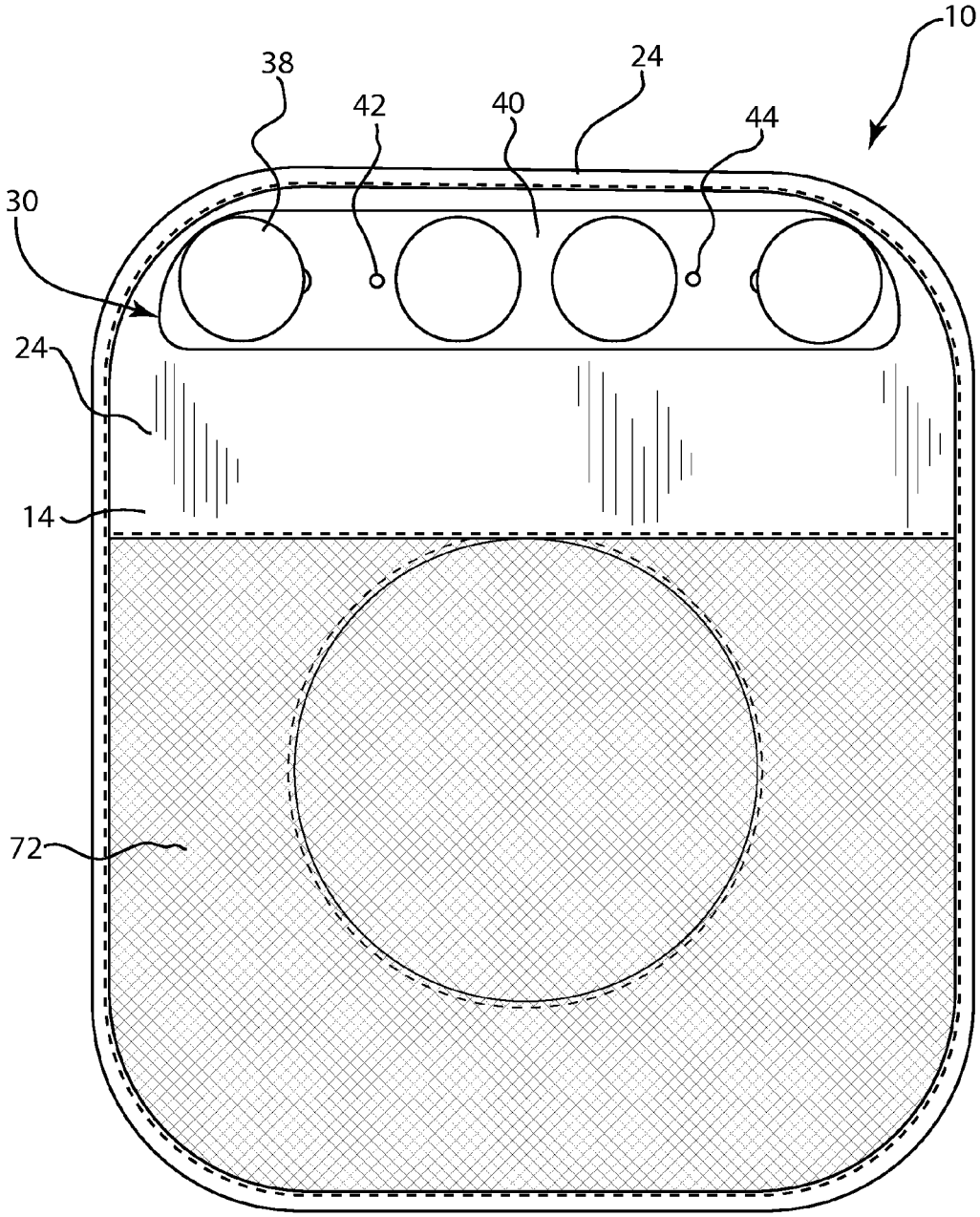
FIG. 2 is a back view of the exemplary device for holding bath toys illustrated in FIG. 1.

Referring now to FIGS. 2 and 3, to attach an exemplary device 10 for holding bath toys to a wall, the mounting plate 30 includes a means for attaching the mounting plate 30 to a wall. In some embodiments, the means for attaching the mounting plate to the wall comprises at least two holes 42,44 defined by the mounting plate 30 and positioned at a predetermined interval along the length of the mounting plate 30 such that a screw, nail, or the like can be inserted through the holes 42,44 to secure the mounting plate to a wall or other suitable surface. In other embodiments, the means for attaching the mounting plate 30 to a wall comprises a plurality of suction cups 38 that are attached to a second side 40 of the mounting plate 30. For example, as illustrated in FIG. 2, in some embodiments, the plurality of suction cups 38 comprises four suction cups that are attached along the length of the second side 40 of the mounting plate to thereby provide a means for securely attaching the mounting plate 30 to a wall or other suitable surface, such as a bath tub door or the like.

Regardless of whether the holes 42,44 or the plurality of suction cups 38 are used to secure an exemplary mounting plate 30 to a wall, to install an exemplary device 10 for holding bath toys, the mounting plate 30 must first be secured to an appropriate wall, such as a glass or tile wall of a bathroom. In one exemplary implementation, where four suction cups 38 are used to attach the mounting plate 30 to a wall, a glass or tile bathroom wall surface is first cleaned and the center of each of the suction cups 38 are lightly wetted. The mounting plate, with the four attached suction cups, is then pressed firmly against the wall such that the mounting plate is secured to the glass or tile surface. After a sufficient amount of time has passed (e.g., 10 min) to allow the suction cups to completely adhere to the wall, the receptacle 12 is then hung on the posts 32,34 of the mounting plate 30 through the two openings 26,28 in the top portion 24 of the back panel 14. The caps 50, 52 including a hooked portion 60 are then inserted onto the posts by positioning each cap 50,52 onto each threaded post 32,34 with the hook portion 60 of each cap facing downward. The caps are then turned 180° clockwise such that the threaded bore 54 of each cap 50,52 engages the corresponding threaded portions of each post 32,34, and the caps 50,52 are secured to the post with the hooked portion 60 facing upward.

An exemplary receptacle 12 of the presently-disclosed devices for holding bath toys is typically fabricated from a flexible material, such as a synthetic material, in order to provide a receptacle that dries quickly and is machine-washable. Various synthetic materials can be used in accordance with the presently-disclosed subject matter and include synthetic materials such as synthetic fibers, neoprene, and the like. Advantageously, the material is machine washable.

Figure 5:
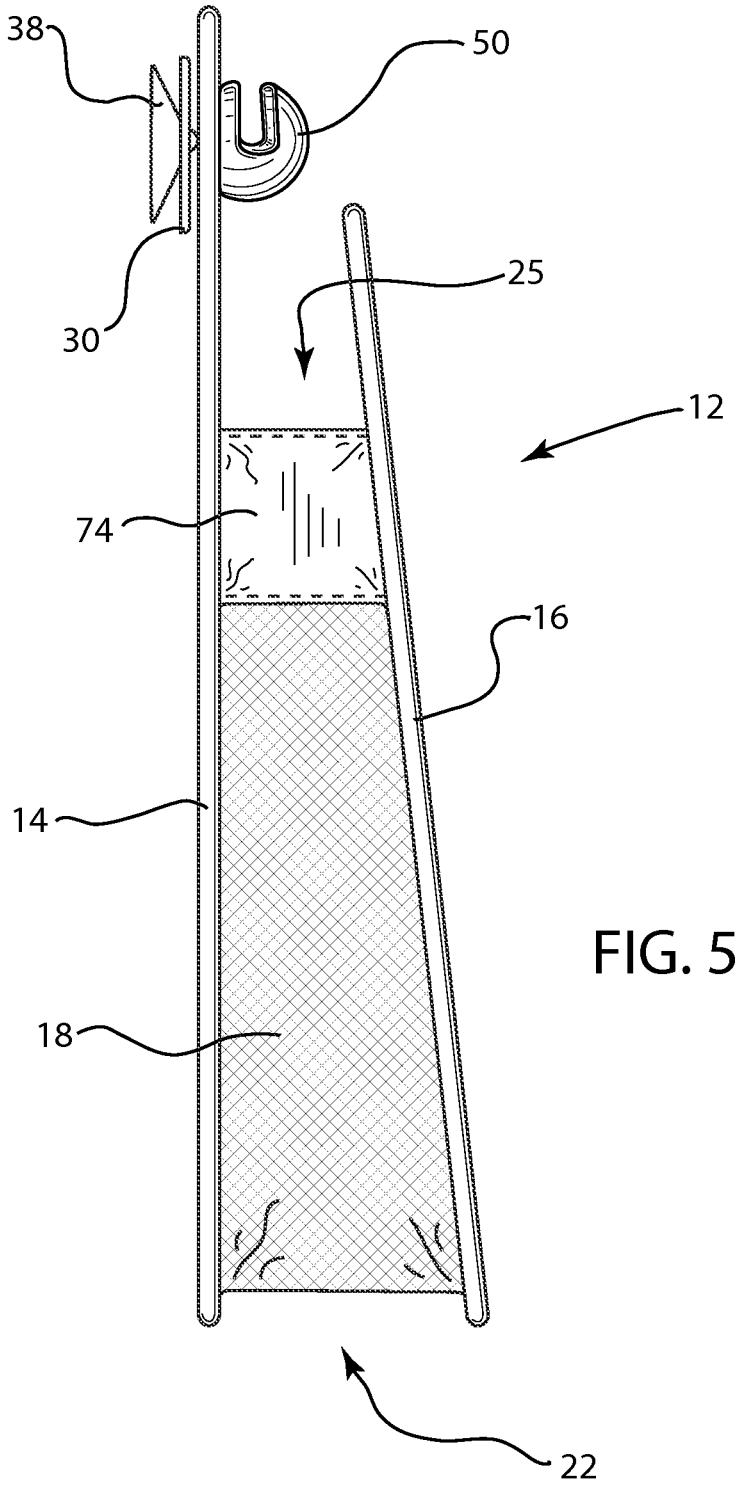
FIG. 5 is a left side view of the exemplary device for holding bath toys illustrated in FIG. 1, the opposite side being nearly a mirror image.
Figure 6:
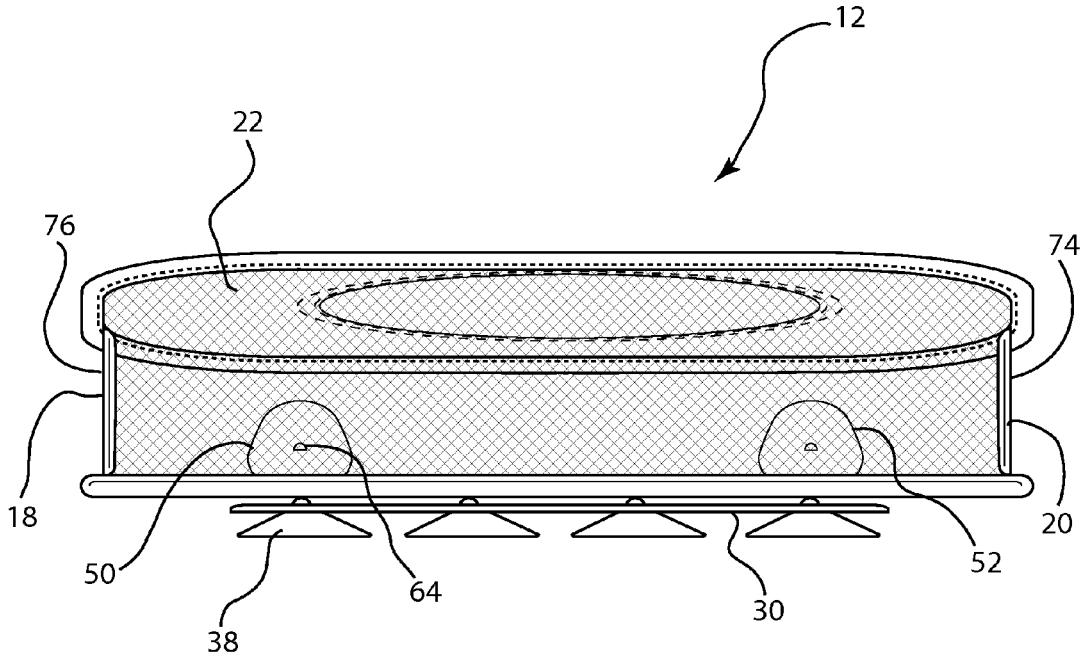
FIG. 6. is a bottom view of the exemplary device for holding bath toys illustrated in FIG. 1.

In some embodiments, the back panel 14 and the front panel 16 of the receptacle 12 are each fabricated from a neoprene material. By fabricating the back panel 14 and front panel 16 of a neoprene material, an exemplary receptacle 12 can be provided that not only dries quickly and is machine washable, but that is also capable of expanding such that the receptacle 12 and its open end 25 are able to stretch to hold and to provide access to a variety of different bath toys of varying shapes and sizes. To further enhance the ability of the presently-disclosed devices for holding bath toys to hold a variety of different bath toys of varying shapes and sizes, in some embodiments, the opposing sides 16,18 of the receptacle 12 comprise a pair of gussets such that the open end 25 is narrower than the bottom 22 of the receptacle 12, as illustrated in FIG. 5.

In order to allow toys held within the presently-disclosed devices for holding bath toys to dry, an exemplary receptacle 12 is also comprised, at least in part, of a mesh material that allows water and other bath liquids to drain from the toys and also allows air to circulate within the receptacles so that the bath toys dry between uses. As noted herein, in some exemplary embodiments, at least a portion of the bottom 22 of the receptacle 12 is formed of a mesh material. In some embodiments, and as shown in FIG. 2, a bottom portion 72 of the back panel 14 is comprised of mesh. In some embodiments, the opposing sides 16,18 and the bottom 22 of the receptacle 12 are comprised of a mesh such that the sides 16,18 and the bottom 22 of the receptacle 12 form a continuous mesh that adjoins the front panel 16 to the back panel 14, as is illustrated in FIG. 1. Accordingly, although device 10 is depicted as having mesh material forming the entire opposing sides 16,18 and bottom 22, in accordance with the present disclosure, the sides 16,18 and/or bottom 22 may have only a portion which is a mesh material, holes or other means to allow water to drain from the receptacle 12.

Referring still to FIG. 1, in some embodiments of the presently-disclosed devices for holding bath toys, mesh can be incorporated into the receptacle in order to serve additional functions besides the draining of liquids from toys. For example, in some embodiments, the front panel 16 of a receptacle 12 comprises a mesh window 70 such that an individual can view one or more contents that are held within an exemplary device 10 for holding bath toys. In some exemplary embodiments, the mesh window comprises about fifty-percent of the surface area of the front panel 16 of the receptacle 12. In the exemplary embodiment illustrated in FIG. 1, the mesh window 70 is a essentially a circular porthole that allows an individual to view any toys that may be held within the receptacle 12. Of course, to the extent it may be desired, various other configurations and sizes of mesh windows can be incorporated into a front panel 16 of a receptacle 12 without departing from the spirit and scope of the subject matter disclosed herein.

Further provided in some embodiments of the presently-disclosed devices for holding bath toys are a pair of opposing side panels 74,76 that are adjoined to an end of the opposing sides 16,18, the front panel 16, and back panel 14 of an exemplary receptacle 12. In some embodiments, the pair of opposing side panels 74,76 further define the open end 25 of the receptacle 12 to provide a roomier open end 25 that allows an individual to more readily access one or more bath toys that may be held within the receptacle 12. Further, by providing opposing side panels 74,76 in embodiments where the opposing sides 18, 20 and the bottom 22 form a continuous mesh, the side panels 74,76 effectively prevent the continuous mesh from tearing that may otherwise occur when an individual is placing or removing bath toys from the receptacle.

The above-described devices for holding bath toys provide a useful means to collect and store bath toys that may otherwise be left lying in the bottom of a bathtub. The presently-disclosed devices for holding bath toys can be readily installed and removed from a variety of bathroom walls and, by providing a receptacle that is removable from a mounting plate, the receptacle itself may be easily removed and cleaned without having to uninstall the entire device. Furthermore, by providing a receptacle that is comprised of neoprene and mesh, as opposed to a plastic receptacle, receptacles are provided that not only allow the receptacles and toys held within them to dry quickly, but that are also are bisphenol A (BPA)- and phthalate-free, which is of great importance in reducing the health risks associated with these two chemicals. Additionally, fabricating the devices out of a flexible neoprene material allows the devices to be fabricated in a variety of different colors to make bath time a more enjoyable occasion for children.

One of ordinary skill in the art will recognize that additional embodiments are also possible without departing from the teachings of the presently-disclosed subject matter. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and can be made without departing from the spirit and scope of the presently-disclosed subject matter.

What is claimed is:

1. A device for holding bath toys, comprising:

a flexible receptacle having a back panel and a front panel adjoined by opposing sides and a bottom of the receptacle, wherein at least a portion of said bottom of the receptacle is formed of a mesh material, and said top portion of the back panel and an upper edge of the front panel define an open end of the receptacle;

at least two posts for attachment to a wall; and at least two caps, each cap defining a bore for receiving the post and for secure attachment to the post, and each cap including an open hook portion with a free end, the hook portion extending from a bottom portion of the cap towards its free end for hanging a bathtub accessory.

2. The device of claim 1, wherein the caps are selectively removable from the posts.

3. The device of claim 1, wherein a back surface of each cap is wider in diameter than openings in the top portion of the back panel, through which openings, each of the at least two posts traverse, respectively.

4. The device of claim 1, wherein the at least two posts and the bore in each cap are threaded.

5. The device of claim 4, further comprising a means for interlocking each cap to each threaded post.

6. The device of claim 5, wherein the means for interlocking each cap to each threaded post comprises at least one threaded segment on each post extending in a direction parallel to the longitudinal axis of the post and at least one groove defined in the threaded bore of the cap for receiving the at least one threaded segment on each post.

7. The device of claim 1, wherein the bottom portion of each cap defines an aperture for draining liquids from a concave portion of the cap.

8. The device of claim 1, wherein the at least two posts are associated with a respective number of suction cups for attachment to the respective posts.

9. The device of claim 1, wherein the back panel and the front panel are comprised of a neoprene material.

10. The device of claim 1, wherein the opposing sides of the receptacle comprise a pair of gussets such that the open end of the receptacle is narrower than the bottom of the receptacle.

11. The device of claim 1, wherein the front panel comprises a mesh window.

12. The device of claim 11, wherein the mesh window comprises about fifty-percent of the surface area of the front panel.

13. The device of claim 1, wherein a bottom portion of the back panel is comprised of mesh.

14. The device of claim 1, wherein the opposing sides and the bottom of the receptacle comprise a continuous mesh.

15. The device of claim 14, further comprising a pair of opposing side panels, each of said side panels being adjoined to an end of the opposing sides, the front panel, and the back panel, and wherein said side panels further define the open end of the receptacle.

16. The device of claim 1, wherein the receptacle has at least two openings for receiving the at least two posts, respectively.

17. A device for holding bath toys, comprising:

a flexible receptacle having a back panel, a front panel, and a bottom area, at least a portion of said bottom area of the receptacle comprising a mesh material, and a top portion of the back panel and an upper edge of the front panel defining an open end of the receptacle;

a means for attaching the receptacle to a wall; and at least one open hook attached to said means for attaching the receptacle to the wall, said at least one hook for hanging a bath tub accessory, and each open hook having free end and including a bottom portion that defines an aperture for draining liquids.

18. The device of claim 17, wherein the means for attaching the receptacle to a wall comprises a post attached to the hook on one end and a suction cup on the other end, for attachment to the wall.

19. The device of claim 17, wherein the receptacle has at least two openings for receiving the at least two posts, respectively.

20. The device of claim 18, wherein the receptacle has at least two openings for receiving the at least two posts, respectively.

21. The device of claim 1, wherein the hook portion has an aperture extending in a direction parallel to a longitudinal axis of the receptacle and parallel to the wall to which the receptacle is attached.

22. The device of claim 17, wherein the aperture is through the hook in a direction parallel to a longitudinal axis of the receptacle and parallel to the wall to which the receptacle is attached.

* * * * *